US006712357B1

(12) United States Patent
Tranquilla

(10) Patent No.: US 6,712,357 B1
(45) Date of Patent: Mar. 30, 2004

(54) DOCUMENT PINCH FORCE CONTROL WITH SOFT PINCH ROLLERS AND DOCUMENT PINCH FORCE CONTROL

(75) Inventor: Michael N. Tranquilla, Livonia, MI (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 09/834,340

(22) Filed: Apr. 13, 2001

(51) Int. Cl.[7] ..... B65H 5/06; B65H 7/20
(52) U.S. Cl. ..... 271/273; 271/258.01
(58) Field of Search ..... 271/273, 258.02, 271/258.01, 265.01

(56) References Cited

U.S. PATENT DOCUMENTS 4,842,110 A * 6/1989 Luckhurst ..... 192/16
5,239,904 A * 8/1993 Yamaguchi et al. ..... 83/210
5,249,795 A * 10/1993 Nishimoto ..... 271/265.02
5,253,862 A * 10/1993 Acquaviva et al. . 271/265.01 X
5,575,466 A * 11/1996 Tranquilla ..... 271/258.01 X
6,065,746 A 5/2000 Tranquilla
6,206,368 B1 * 3/2001 Kobayashi et al. ..... 271/273
6,338,483 B1 * 1/2002 Andela et al. ..... 271/265.01 X

* cited by examiner

*Primary Examiner*—Kathy Matecki
*Assistant Examiner*—Scott J. Haugland
(74) *Attorney, Agent, or Firm*—Lise A. Rode; Mark T. Starr; Harness Dickey & Pierce, P.L.C.

(57) ABSTRACT

An apparatus for providing pinch force control to an entrance transport element in a document handling system. The entrance transport element includes a drive roller element and a pinch roller element and a pinch force relief mechanism coupled to the pinch roller element. The pinch force relief mechanism is positionable between a pinch force mode and a non-pinch force mode. A control element is adapted to control actuation of the pinch force relief mechanism between the pinch force mode and the non-pinch force mode. When the control element places the pinch force relief mechanism in the pinch force mode, the pinch roller element is positioned such that a pinch force is exerted on a document. Conversely, when the control element places the pinch force relief mechanism in the non-pinch force mode, the pinch roller element is positioned such that a pinch force is prevented from being exerted on the document.

15 Claims, 5 Drawing Sheets

DOCUMENT PINCH FORCE CONTROL WITH SOFT PINCH ROLLERS AND DOCUMENT PINCH FORCE CONTROL

BACKGROUND OF THE INVENTION

1. Field of the Invention

This invention relates generally to document handling systems, and more particularly, to the control of entrance transport element pinch force on documents of various lengths.

2. Discussion

Document handling systems, such as check processors, tag printers and ticket printers, are used to process a variety of documents at high speeds. FIG. 1 illustrates a conventional system used in a document handling system for stopping a document in a high speed transport so it can be printed on with a printer. As shown, the conventional system typically includes an entrance transport element 12 having a drive roller element 14 and a corresponding pinch roller element 16. The system also includes a capstan element 18, a pinch roller element 20 corresponding to the capstan element 18, an edge sensor 22, a hammer bank 24, a print drum 26, a ribbon 28, and an exit transport element 30. The exit transport element includes a drive roller element 32 and a corresponding pinch roller element 34. In the example shown, MICR amount fields are being printed on a check 10.

Documents come in a variety of weights and lengths. For example, in check processing, the document lengths range from about 5 inches to 9 inches. FIG. 1 illustrates the case of a relatively short document 10. In particular, FIG. 1*a* shows a document 10 moving toward a print station. As shown, the entrance drive element 14 and pinch roller element 16 are in contact with the document 10. Typically, a document 10 is moved at high speed up to a print station by the entrance transport element 12. When the document 10 is in the grip of the capstan element 18 only, the capstan element 18, and hence the document 10, is decelerated to the desired stop position, shown in FIG. 1*b*. For precise positioning, the leading edge 10*a* of the document is sensed by the edge sensor 22. The edge sensor 22 is a known distance from the desired stop position. The motion of the capstan element 18 is controlled by a single motor (not shown) which is part of a servo loop.

After printing, the document 10 is accelerated up to the speed of the exit transport element 30 by the capstan element 18. The exit transport element 30, usually running at high, constant speed, moves the document 10 to other devices for further processing shown in FIG. 1*c*.

As is conventionally known, each of the pinch roller elements 16, 20 and 34 are normally spring loaded against the entrance 12 and exit 30 drive roller elements and against the capstan element 18, respectively, in order to provide drive force for the document. A pinch force $F_p$ is generated by the interaction of the drive roller element 14 or 32 or capstan element 18 and the respective pinch roller element. The pinch force $F_p$ is applied to the document 10 generally perpendicular to the path of travel.

If the document 10 is short enough, it will not be under the influence of the entrance transport element 12 while the capstan element 18 is decelerating it and holding it in the print position.

However, because some document processing, such as check processing, requires that multiple documents of varying length be processed, reliable document transporting dictates that at least one drive or capstan roller element be contacting the document at all times. As such, drive roller and capstan element spacing needs to be small to reliably transport short documents. Unfortunately, this results in long documents being under the influence of a drive roller and capstan element for a greater period of time, which has an undesirable effect on document handling apparatus performance.

FIG. 2 illustrates printing on a relatively long document 10' using conventional methods. As best shown in FIG. 2*b*, a long document 10' is under the influence of the entrance transport element 12 when the capstan element 18 is decelerating and attempting to maintain the document position during printing. To keep the document 10' from buckling, from slipping forward during deceleration, and to help the capstan element 18 hold the document 10' in position, the small pinch forces $F_p$ are typically used at the entrance transport element 12 to allow the drive roller element 14 to slip. Unfortunately, this action usually compromises document transport reliability since there is still some force on the document due to the friction between the document 10' and the entrance drive roller 14 when the document 10' is being driven by 12 with low drive force during its approach to the print station.

SUMMARY OF THE INVENTION

It is an thus object of the present invention to provide shorter stopping and starting times to improve throughput in document processing equipment.

Another object of the present invention is to remove the entrance transport pinch force during document deceleration and stop during document processing, and then return the pinch force just after processing is completed and the document is delivered to the exit transport.

The present invention is directed to an apparatus for providing pinch force control to the entrance transport element in a document handling system. The document handling system includes an entrance transport element comprising a drive roller element and a pinch roller element. A pinch force relief mechanism is coupled to the pinch roller element and is positionable between a pinch force mode and a non-pinch force mode. The apparatus also includes a control element adapted to control actuation of the pinch force relief mechanism between the pinch force mode and the non-pinch force mode. When the control element places the pinch force relief mechanism in the pinch force mode, the pinch roller element is positioned such that a pinch force is exerted on a document. Conversely, when the control element places the pinch force relief mechanism in the non-pinch force mode, the pinch roller element is positioned such that no pinch force is exerted on the document.

Accordingly, depending upon document length, the pinch force is automatically removed from entrance transport element, preventing external forces from affecting the positioning of the document.

Furthermore, a dashpot may be added to better control motion of the pinch force relief mechanism.

BRIEF DESCRIPTION OF THE PREFERRED EMBODIMENTS

Additional objects, features, and advantages of the present invention will become apparent from studying the following detailed description and claims when taken in conjunction with the accompanying drawings, in which:

FIGS. 1*a*, 1*b* and 1*c* are a plan view of a conventional system for transporting documents, wherein the document is relatively short;

FIGS. 2*a*, 2*b*, and 2*c* are a plan view of a conventional system for transporting documents, wherein the document is relatively long;

FIGS. 3*a*, 3*b*, and 3*c* are a plan view of a preferred embodiment of the document pinch force control apparatus according to the principles of the present invention;

DETAILED DESCRIPTION OF THE PREFERRED EMBODIMENTS

Figure 1A:
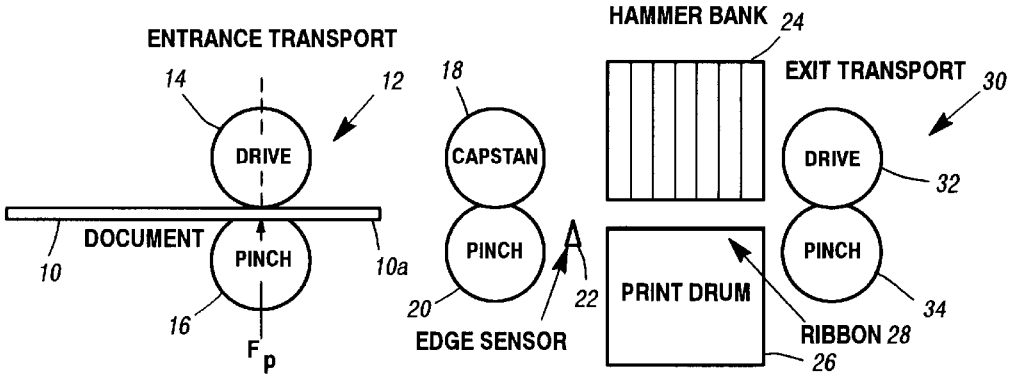
Fig. 1a (Prior Art)
Figure 1B:
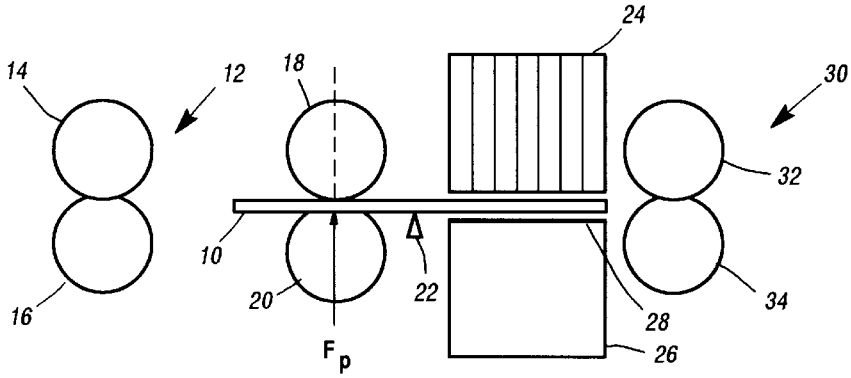
Fig. 1b (Prior Art)
Figure 1C:
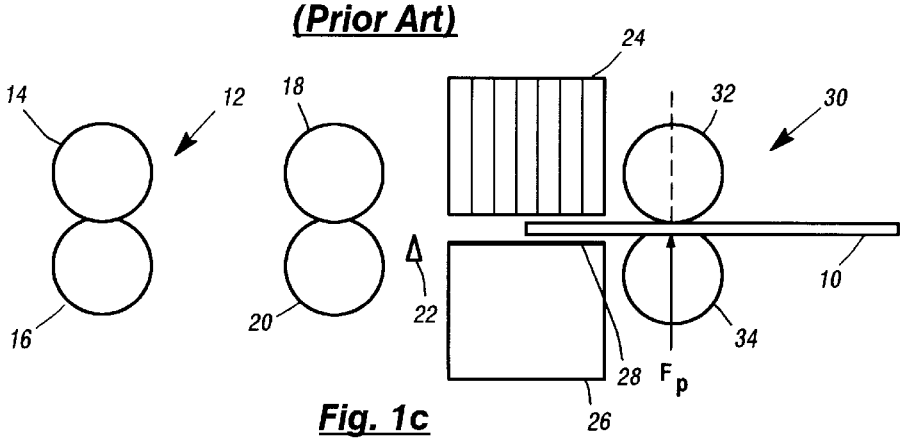
Fig. 1c (Prior Art)
Figure 2A:
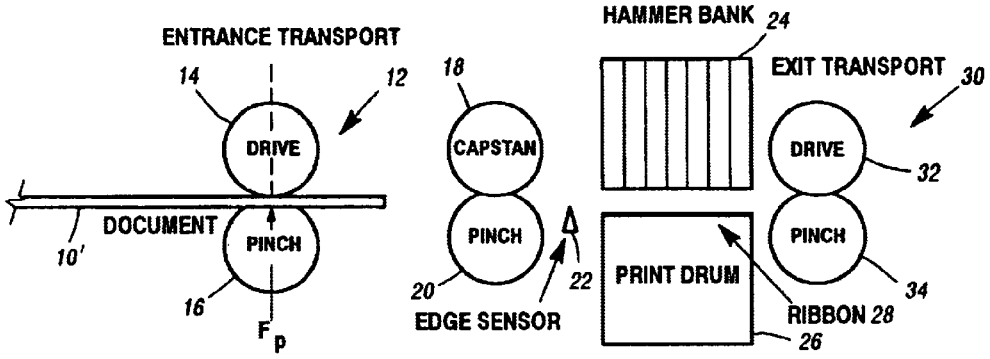
Fig. 2a (Prior Art)
Figure 2B:
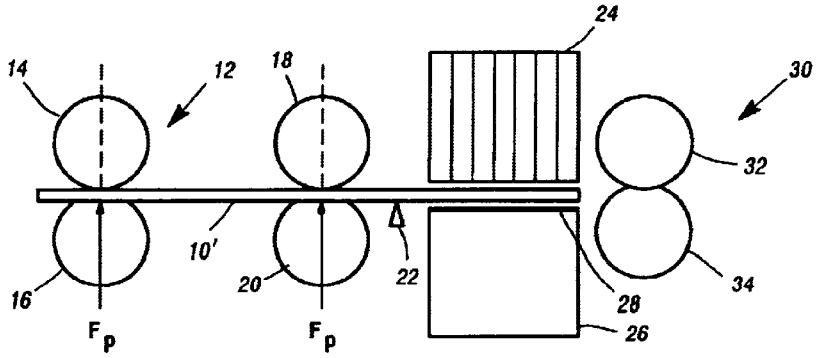
Fig. 2b (Prior Art)
Figure 2C:
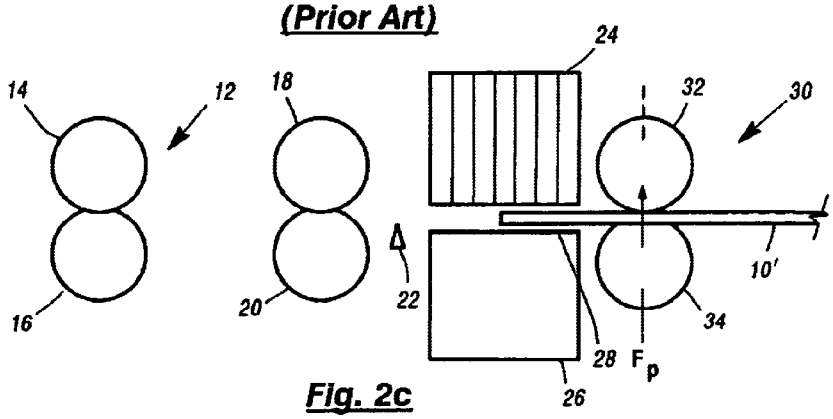
Fig. 2c (Prior Art)

The drawings show merely exemplary embodiments of the present invention for purposes of illustration only, and one skilled in the art will readily recognize that the principles of the invention are well adapted for application to devices other than document handling systems as well as to document handling systems other than the one shown in the drawings. Furthermore, one skilled in the art will readily appreciate that various adaptations of the preferred embodiments may be combined or otherwise modified without departing from the scope of the invention.

This invention may be applied to any device that requires a document to be stopped in an accurate position in order to process it or perform some process on it.

Figure 3A:
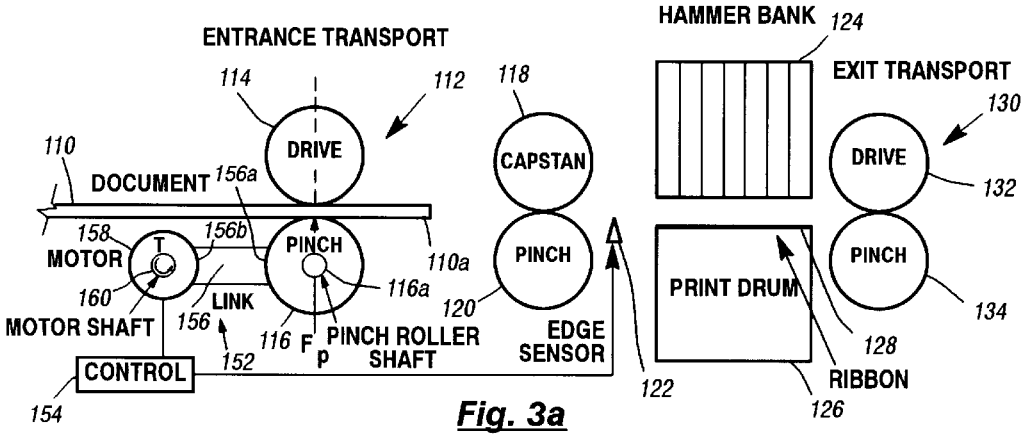
Figure 3B:
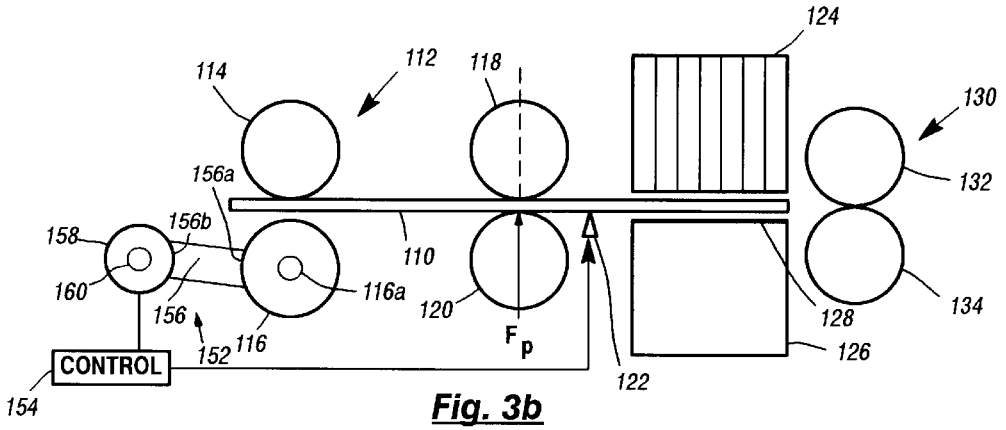
Figure 3C:
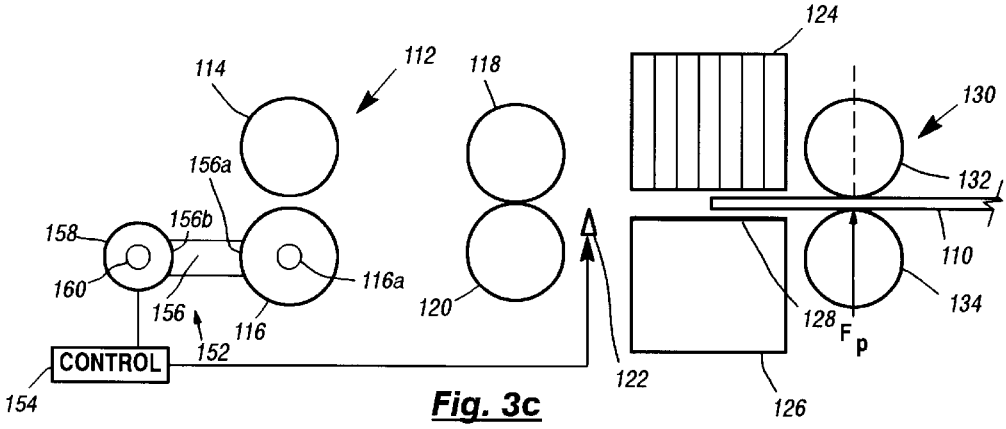

FIGS. 3*a*, 3*b*, and 3*c* show a document 110 in a transport. As shown, the transport includes an entrance transport element 112. The entrance transport element 112 includes a drive roller element 114 and a corresponding pinch roller element 116. The pinch roller element 116 for the entrance transport 112 is allowed to rotate about a pinch roller shaft 116*a*. The system also includes a capstan element 118, a pinch roller element 120 corresponding to the capstan element, an edge sensor 122, a hammer bank 124, a print drum 126, a ribbon 128, and an exit transport element 130. The exit transport element includes a drive roller element 132 and a corresponding pinch roller element 134.

As shown in FIG. 3*a*, initially only the entrance transport element 112 is in contact with the document 110. The document 110 is moved at high speed up to a print station by the entrance transport element 112. When the document 110 is in the grip of the capstan element 118, the capstan element 118, and hence the document 110, is decelerated to the desired stop position. For precise positioning, the leading edge 110*a* of the document is sensed by the edge sensor 122. The edge sensor 122 is a known distance from the desired stop position. The motion of the capstan element 118 is controlled by a single motor (not shown) which is part of a servo loop.

The apparatus of the present invention includes a pinch force relief mechanism 152 and a control element 154. The pinch force relief mechanism 152 is coupled to the entrance pinch roller element 116 and includes a link member 156, a power supply 158 and an output shaft 160. The link member 156 has a first end 156*a* fixed to the pinch roller shaft 116*a* and a second end 156*b* connected to the output shaft 160. The power supply 158, preferably an electric motor, applies a torque T to the output shaft 160 when it is energized with electric current. As shown in FIG. 3*a*, when the direction of current provides counterclockwise motor torque, a pinch force $F_p$ is produced between the drive 114 and pinch rollers 116 via the connections between the output shaft 160, the link member 156, the pinch roller shaft 116*a* and pinch roller 116*b*. Alternatively, as shown in FIG. 3*b*, when current is cut off from the motor 158, no torque T is applied to the output shaft 160. As such, the first end 156*a* of the link member 156 and the pinch roller element 116 are displaced away from the drive roller element 114, thereby removing the pinch force $F_p$.

It is well known that document tracking systems can keep track of the position of a document in a transport by using edge sensors and appropriate electronic logic or computers. It is also well known that such tracking systems can measure the length of a document and have access to the length information at any position of the document along the track where an edge sensor is located. As such, these features will be understood by one of ordinary skill in the art and will not be discussed in detail.

Figure 4:
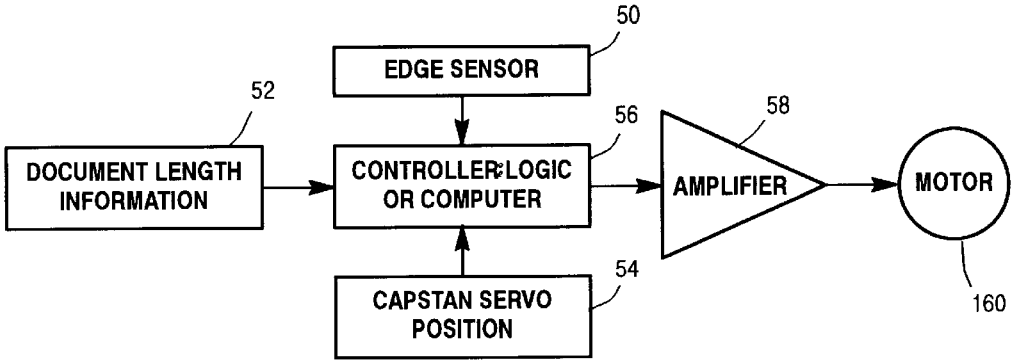
FIG. 4 is a block diagram of a preferred motor control according to the principles of the present invention.

The control element 154 selectively activates the pinch force relief mechanism 152 between a pinch force mode and a non-pinch force mode. Specifically, the control element 154 selectively activates the motor 160. FIG. 4 is a block diagram illustrating the motor control. As shown, an electrical signal from the edge sensor (process block 50) is input into a controller (process block 56). Likewise, an electrical signal indicating the document length in the tracking system (process block 52) is input into the controller 56. In addition, an electrical signal indicating the capstan element servo position (process block 54) is input into the controller 56. The controller 56 includes either hardwired logic or a computer (microprocessor) to implement an algorithm for controlling the pinch force relief mechanism (see FIG. 5). An electrical signal from the controller 56 is then fed to an amplifier 58 which turns the motor current on or off, depending on the nature of the controller signal.

Figure 5:
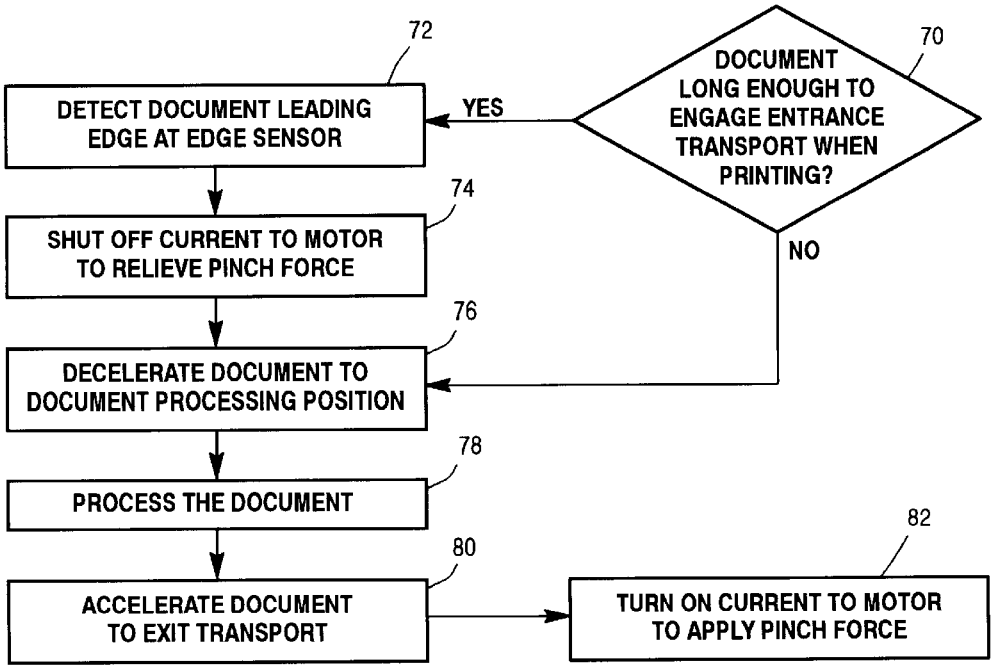
FIG. 5 is a block diagram of a preferred algorithm for controlling the pinch force relief mechanism.

The Flowchart of FIG. 5 illustrates an algorithm for turning the motor current off and on. The algorithm initiates as decision block 70 inquires if the document is long enough to engage the entrance transport while printing.

If the answer to the inquiry is affirmative, the leading edge of a document is detected by the edge sensor, as shown in process block 72. Motor current is then turned off (74). This removes the torque T being generated by the motor 158 and also removes the pinch force $F_p$ as illustrated in FIG. 3*b*. The pinch force relief mechanism 152 is thus in a non-pinch force mode. Although the entrance transport pinch force $F_p$ is removed, the document 110 is still well controlled by the pinch force $F_p$ of the capstan element 118 since the edge sensor 122 is downstream of the capstan element 118. Although the entrance pinch roller 116 shown in FIG. 3*b* leaves contact with the document 110, it may alternatively remain in contact even if the pinch force is zero.

The document 110 is decelerated to document processing position, as shown in process block 76. The document processing is then performed (decision block 78). After the document processing is complete, the motor current can be turned on to re-apply the pinch force $F_p$. Also, the capstan element 118 accelerates the document 110 (process block 80) toward and up to the speed of the exit transport element 130. Re-applying the pinch force $F_p$ of entrance transport element 112 (process block 82) at the instant of capstan element 118 acceleration helps the capstan element 118 accelerate the document 110.

If the answer to the inquiry in decision block 70 regarding document length is negative, motor current is left on. This allows the torque T generated by the motor 158 to continue and also allows the pinch force $F_p$ of entrance transport element 112 to be exerted. The pinch force relief mechanism 152 is thus in a pinch force mode. The document 110 is decelerated to document processing position, as shown in process block 76. The document processing is then performed (decision block 78). After the document processing is complete, the motor current continues to apply the pinch force $F_p$ to the entrance transport element 112. The capstan element 118 accelerates the document 110 (process block 80) toward and up to the speed of the exit transport element 130. Applying the pinch force $F_p$ of the entrance transport element 112 (process block 82) at the instant of capstan element 118 acceleration helps the capstan element accelerate the document 110.

Figure 6A:
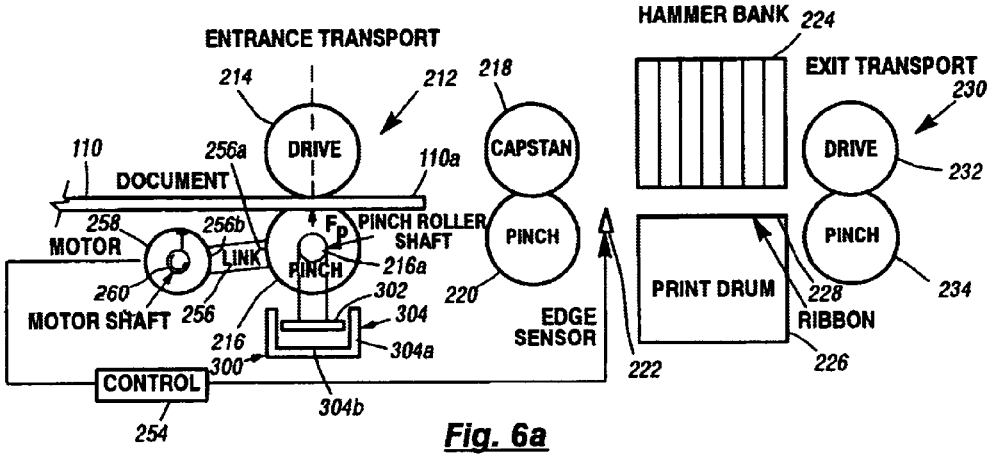
FIGS. 6*a*, 6*b* and 6*c* are a plan view of another preferred embodiment of the document pinch force control apparatus, according to the principles of the present invention, wherein the apparatus includes a dashpot.
Figure 6B:
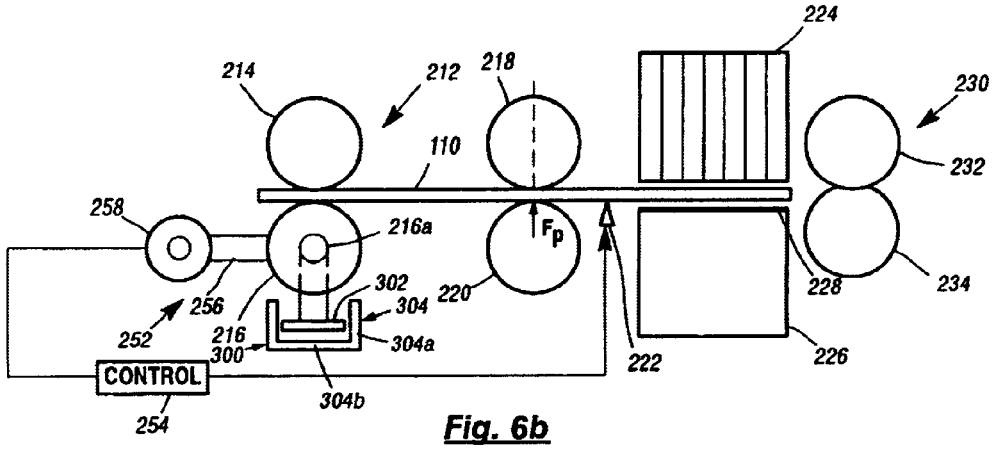
Figure 6C:
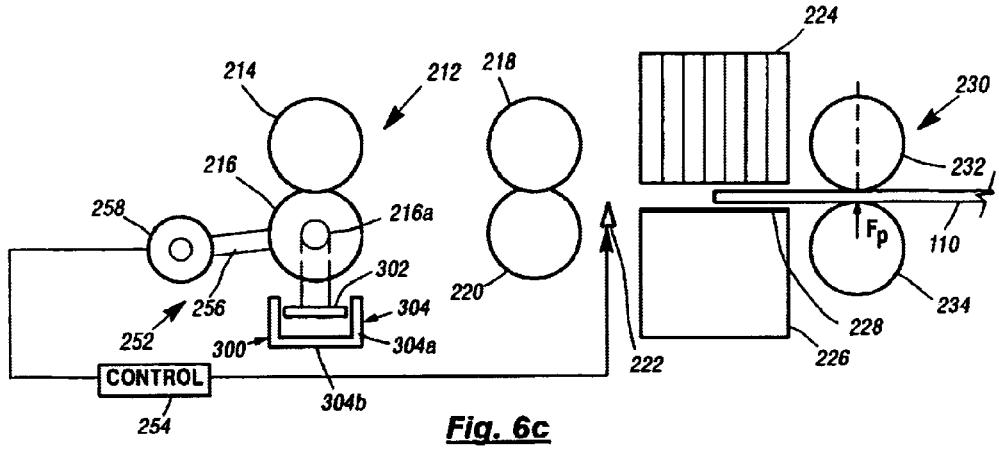

FIGS. 6*a*, 6*b*, and 6*c* illustrate another preferred embodiment of the document pinch force control apparatus, according to the principles of the present invention, wherein the apparatus further includes a dashpot 300. Components that are similar to those described with reference to the first preferred embodiment are annotated with similar reference numerals incremented by 100.

As shown in the conventional systems of FIGS. 1*a*, 1*b*, and 1*c* and FIGS. 2*a*, 2*b* and 2*c*, the pinch roller elements 16, 20, and 34 appear substantially distorted. It is known in the art that soft pinch roller elements often provide more reliable document handling, especially with documents that have folds, staples, or other mutilations. As such, the rollers of pinch roller elements are often made of a soft material such as elostomer.

Because of the soft nature of the pinch roller, considerable elastic energy can be stored in the pinch roller element when the pinch force is applied. When the pinch force is removed, the stored elastic energy is released, much of which is converted to kinetic energy.

The present invention is adapted to be used with soft pinch rollers while also preventing the elastic energy from being converted to kinetic energy. Specifically the embodiment shown in FIGS. 6*a*, 6*b*, and 6*c* include the dashpot 300 connected to the pinch roller shaft 216*a*. The dashpot 300 preferably includes a plunger 302 and a cup 304, as shown in FIGS. 6*a*, 6*b* and 6*c*. One end of plunger 302 is connected to the pinch roller shaft 216*a*. The other end is disposed inside the cup 304. The cup 304 is suitably fixed to the frame of the machine (not shown). The cup includes a side 304 and a base 304*b*. A small clearance exists between the plunger 302 and the side 304*a* of the cup.

When the pinch force at the entrance transport element 212 is removed, as shown in FIG. 6*b*, the pinch roller shaft 216*a* moves away from the pinch point as the elastic energy is being released. The plunger 302 moves toward the base 304*b* of the cup. Air in the base 304*b* of the cup is forced out between the small clearance between the plunger 302 and side 304*a* of the cup. This action produces viscous drag forces which consume a large portion of the elastic energy of the plunger 302. Therefore, there is much less elastic energy converted to kinetic energy. With smaller kinetic energy, the motion of the pinch roller element 216 and pinch force relief mechanism 252 is much smaller. The pinch force can then be returned in a more timely fashion.

It can thus be seen that the present offers certain advantages over conventional techniques in the art. Depending upon document length, the pinch force is automatically removed from the entrance transport element, thereby preventing external forces from affecting the positioning of the document. This not only improves performance, but also improves service life of the components of the pinch roller elements. In addition, when a dashpot is included as part of the apparatus, an even more precise control of the pinch force relief mechanism can be obtained.

The foregoing discussion and drawing discloses and describes merely an exemplary embodiment of the present invention. One skilled in the art will readily recognize from such discussion that various changes, modifications and variations may be made therein without departing from the scope of the invention as defined in the following claims.

What is claimed is:

1. In a document handling system in which individual documents are moved with an entrance transport toward a processing station, the entrance transport including a drive roller element and a pinch roller element, wherein the system further includes a capstan element downsstream of the entrance transport and an edge sensor for detecting document edges wherein the capstan element is controlled to decelerate a document to stop the document at a desired stop position for processing and subsequently accelerate the document toward an exit transport, an apparatus for providing pinch force control to the entrance transport, the apparatus comprising:

a pinch force relief mechanism coupled to the pinch roller element and positionable between a pinch force mode and a non-pinch force mode; and a control element for controlling actuation of the pinch force relief mechanism between the pinch force mode and the non-pinch force mode, wherein the pinch force mode positions the pinch roller element such that a pinch force is exerted on a document and wherein the non-pinch force mode displaces the pinch roller element such that no pinch force is exerted on the document and wherein the control element is programmed to determine whether the stopped document would still engage the entrance transport, and if so, upon detecting the document with the edge sensor, momentarily displacing the pinch roller element to prevent the pinch force from being exerted on the document while the document is stopped.

2. The apparatus of claim 1, further comprising:

a power supply having an output shaft, wherein the pinch force relief mechanism includes a link member having a first end and a second end, said first end being operably attached to the pinch roller element and the output shaft being operably connected to said second end.

3. The apparatus of claim 2, wherein said power supply is an electric motor.

4. The apparatus of claim 1, wherein the control element includes a stored program mechanism.

5. The apparatus of claim 1, wherein said pinch force mechanism further comprises a dashpot having a plunger coupled to the pinch roller element and a cup for receiving said plunger.

6. In a document handling system in which individual documents are moved with an entrance transport toward a processing station, the entrance transport including a drive roller element and a pinch roller element, wherein the system further includes a capstan element downstream of the entrance transport and an edge sensor for detecting document edges wherein the capstan element is controlled to decelerate a document to stop the document at a desired stop position for processing and subsequently accelerate the document toward an exit transport, an apparatus for providing pinch force control to the entrance transport, the apparatus comprising:

a link member having a first end and a second end, said first end being operably attached to the pinch roller shaft, said link member being pivotally positionable about said second end between a pinch force mode and a non-pinch force mode;

a power supply having an output shaft operably connected to said second end of said link member, said power supply capable of providing a torque thereto; and a control element for selectively activating the power supply, wherein activation of said power supply exerts a torque on said link member and positions said link member into the pinch force mode such that pinch roller element exerts a pinch force on a document, and wherein deactivation of said power supply removes a torque on said link member and positions said link member into the non-pinch force mode such that the pinch roller element is displaced, thereby preventing a pinch force from being exerted on a document and wherein the control element is programmed to determine whether the stopped document would still engage the entrance transport, and if so, upon detecting the document with the edge sensor, momentarily displacing the pinch roller element to prevent the pinch force from being exerted on the document while the document is stopped.

7. The apparatus of claim 6, wherein said power supply is an electric motor.

8. The apparatus of claim 6, wherein the control element includes a stored program mechanism.

9. The apparatus of claim 6, wherein said link-member further comprises a dashpot having a plunger coupled to the pinch roller element and a cup for receiving said plunger.

10. In a document handling system in which individual documents are moved with an entrance transport toward a processing station, the entrance transport including a drive roller element and a pinch roller element, wherein the system further includes a capstan element downstream of the entrance transport and an edge sensor for detecting document edges wherein the capstan element is controlled to decelerate a document to stop the document at a desired stop position for processing and subsequently accelerate the document toward an exit transport, a method for providing pinch force control to the entrance transport, the method comprising:

providing a document to the entrance transport which is driven toward the capstan element;

determining whether the stopped document would still engage the entrance transport;

if the stopped document would still engage the entrance transport, upon detecting the document with the edge sensor, momentarily displacing the pinch roller element to prevent the pinch force from being exerted on the document while the document is stopped.

11. The method recited in claim 10, wherein the processing station is a printing station.

12. The method recited in claim 10, wherein the pinch force on the document is adjusted by positioning a pinch force relief mechanism between a pinch force mode and a non-pinch force mode.

13. The method recited in claim 12 wherein the positioning of the pinch force relief mechanism is controlled by the activation of a power supply.

14. The method recited in claim 13 wherein a control element is adapted to control activation of the power supply.

15. The method recited in claim 13 wherein the control element includes a stored program mechanism.

* * * * *